US006016289A

United States Patent [19]

Kaelin

[11] Patent Number: 6,016,289

[45] Date of Patent: Jan. 18, 2000

[54] GENERATOR DRIVING DEVICE FOR AN INSTRUMENT OF SMALL VOLUME

[75] Inventor: Laurent Kaelin, Sonvilier, Switzerland

[73] Assignee: Eta Sa Fabriques D'Ebauches, Grenchen, Switzerland

[21] Appl. No.: 09/187,411

[22] Filed: Nov. 6, 1998

[30] Foreign Application Priority Data

Nov. 20, 1997 [CH] Switzerland ..... 2684/97

[51] Int. Cl.[7] ..... G04B 1/00; G04C 3/00

[52] U.S. Cl. ..... 368/203; 368/204

[58] Field of Search ..... 368/64, 76, 80, 368/203–204; 310/79 R, 79 A, 156, 37; 320/2, 21, 41, 42, 61; 322/1, 3, 4, 10

[56] References Cited

U.S. PATENT DOCUMENTS 4,939,707 7/1990 Nagao ..... 360/204
5,001,685 3/1991 Hayakawa ..... 368/204
5,581,519 12/1996 Hara et al. ..... 368/204

FOREIGN PATENT DOCUMENTS 0 326 312 8/1989 European Pat. Off. .
1 242 818 1/1961 France .
333 992 12/1958 Switzerland .
337 128 4/1959 Switzerland .

*Primary Examiner*—Vit Miska
*Attorney, Agent, or Firm*—Sughrue, Mion, Zinn, Macpeak & Seas, PLLC

[57] ABSTRACT

The power generator (1) powers an instrument of small volume and is driven, via a gear train, by an oscillating weight (2), said train including a plurality of wheels and pinions (18, 4, 6, 19) arranged in a chain (3). The chain includes a sliding wheel and pinion (4) arranged to disengage from at least one of the other wheel and pinions (18) when the weight (2) is subjected to an acceleration substantially exceeding that occurring during normal use of the instrument.

7 Claims, 2 Drawing Sheets

GENERATOR DRIVING DEVICE FOR AN INSTRUMENT OF SMALL VOLUME

The invention relates to a driving device for a power generator for powering an instrument of small volume, this device including a gear train driving said generator from an oscillating weight moved by gravity, this train including a plurality of wheels and pinions arranged in a chain.

In particular, the invention concerns such a device arranged in a wristwatch for winding a mechanical movement or for powering an electronic circuit. Likewise, the invention can concern an electronic unit associated with means for receiving and/or transmitting electromagnetic signals.

Driving devices answering the generic definition given hereinbefore are known, such devices being mounted either in self-winding watches, or in electronic watches.

As regards self-winding watches, the oscillating weight winds, via a gear train, a mainspring of a barrel. In order to avoid overwinding the mainspring at the end of winding, the mainspring is generally fitted with a slipping spring. In order to do this, the outer end of the mainspring is not hooked to the barrel, but fixed to a strip which presses against the wall of the barrel drum occupying slightly more than one turn. This strip is called a slipping spring and allows the mainspring to be wound normally, then to slip against the wall of the drum. However, if for some reason, the slipping spring does not properly fulfil or fails to fulfil the function for which it is provided, when the watch undergoes shocks, there can be breakage either of the mainspring, or the teeth of a gear wheel forming part of the gear train winding the mainspring, the most stressed gear wheel being the wheel attached to the oscillating weight.

As regards electronic watches, European Patent No. A-0 326 312 can be cited. This Patent discloses a driving device for a generator supplying a supercapacitor with electric voltage. In order to do this, the device includes an oscillating weight mechanically coupled to said generator to drive the rotor thereof. In order to preserve the mechanism from any excess stress on the teeth of the gear wheel in the event of a shock and thereby to avoid breakage of such teeth, a friction coupling is provided between the oscillating weight and the generator rotor. In the proposed construction, an intermediate wheel and pinion is inserted between the oscillating weight and the rotor. The weight transmits its movement to a pinion of the intermediate wheel and pinion, the latter including a wheel which is friction fitted on the shaft of the wheel and pinion, this wheel being meshed with a pinion of the generator rotor. The friction is calculated so that the wheel slips on the shaft when a shock is applied to the weight or, if preferred, when the couple applied to the rotor exceeds an admissible value. Any breakage of the mechanism is thereby avoided. It will be noted however that in mass series manufacturing, it is difficult to assure friction of constant value and this therefore requires time-consuming fittings.

In order to overcome the aforementioned inadequacies and drawbacks, the present invention is characterised in that the chain includes a sliding wheel and pinion arranged to disengage from at least one of the other wheel and pinions and thus to interrupt said chain when the oscillating weight momentarily supplies mechanical power substantially exceeding that provided in normal use of said instrument and particularly when this weight is subjected to too high an acceleration.

The invention will be explained in more detail now with reference to the following description of an embodiment and drawings which illustrate it by way of example and in which.

Figure 2:
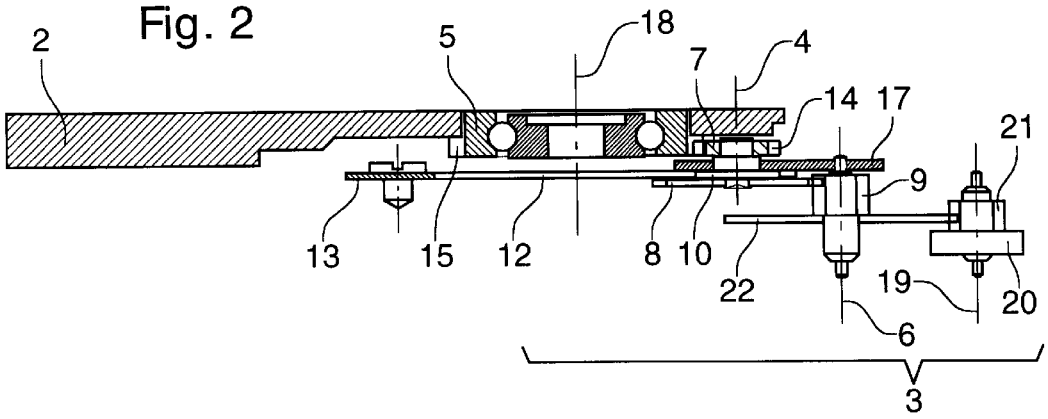
FIG. 2 is a cross section of FIG. 1.
Figure 1:
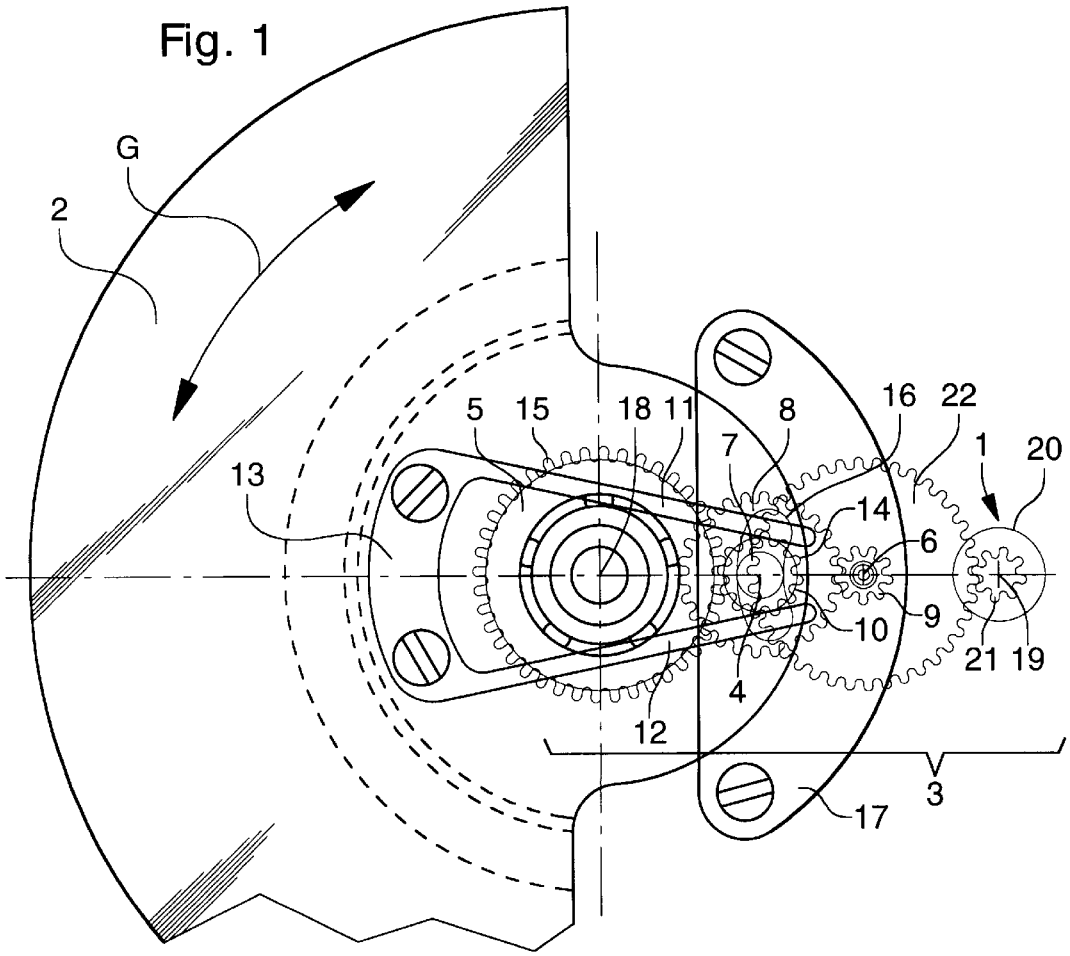
FIG. 1 is a plane view of the device according to the invention showing the oscillating weight acting on the power generator via the gear train.

The driving device for a power generator for powering an instrument of small volume according to the invention is shown in plane in FIG. 1 and in cross-section in FIG. 2. This device includes a gear train including a plurality of wheel and pinions 18, 4, 6 and 19 arranged in a chain 3. This train drives power generator 1 (only one constructive element of a particular embodiment is shown in the drawing) from an oscillating weight 2 moved by gravity and constituting the power source, the rotational movement which results therefrom being illustrated by the double arrow G. The device is fitted to an instrument of small volume which can be, for example, a wristwatch. As is known, the movements of the arm wearing the watch provides weight 2 with a back-and-forth movement which, in mechanical watches, winds the mainspring of the barrel of the watch and, in electronic watches, drives a generator supplying voltage to an accumulator or a supercapacitor, the energy stored in such accumulator or capacitor supplying in turn electronic circuits (quartz, dividers, etc.) assuring proper operation of the watch. In the case of the Figures selected here, the power generator is a generator shown by its rotor 20, this rotor forming, with a pinion 21 which is coaxial thereto, a wheel and pinion 19.

According to the present invention and as is seen in the Figures, chain 3 includes a sliding wheel and pinion 4 arranged to disengage from at least one of the other wheel and pinions (in the embodiment shown, from wheel and pinion 18), and thus to interrupt chain 3, when oscillating weight 2 (forming part, with wheel 15, of wheel and pinion 18) is subjected to accelerations substantially exceeding those occurring in normal use of said instrument. If this instrument is a wristwatch, normal use would be, for example, the swinging of the user's arm, or any other usual movement of the arm. Conversely, dropping of the watch on the ground or any violent movement of the arm striking an object generating accelerations of the weight can damage the device.

A preferred embodiment of the invention will now be described, this embodiment being illustrated by the Figures. In particular, FIGS. 1 and 2 show that a wheel 5 drives sliding wheel and pinion 4 which in turn drives an intermediate wheel and pinion 6, this latter being meshed with generator 1. Chain 3 thus includes four wheel and pinions 18, 4, 6 and 19 meshing one after the other. However, a chain with three wheel and pinions can also be envisaged, the intermediate wheel and pinion then being made the sliding one. This embodiment raises however manufacturing problems.

With reference now to chain 3 shown in the Figures, it is seen that sliding wheel and pinion 4 includes a pinion 7 meshed with wheel 5 attached to oscillating weight 2 and a wheel 8 meshed with a pinion 9 forming part of intermediate wheel and pinion 6, this latter also including a wheel 22 meshed with pinion 21 of wheel and pinion 19. Opposing forces are exerted on the shaft 10 of sliding wheel and pinion 4, shown by arrows A and B, of two strips 11 and 12 of a positioning spring 13. When weight 2 is subjected to accelerations corresponding to normal use of the instrument, sliding wheel and pinion 4 is held in chain 3, as is visible in FIGS. 1 and 3. Conversely, when weight 2 is subjected to accelerations exceeding those occurring in normal use, sliding wheel and pinion 4 follows a trajectory determined so that teeth 14 of its pinion 7 are driven out of the trajectory of teeth 15 of wheel 5 attached to weight 2. When the instrument is subjected to a violent shock (dropping on the ground for example), generator 1 can be considered as blocked, as can intermediate wheel and pinion 6 and sliding wheel and pinion 4 which is meshed therewith. In other words, the stress on teeth 15 of wheel 5 attached to weight 2 greatly increases because of the added inertia of generator 1. If thus wheel 5 were directly meshed with pinion 9 of intermediate wheel and pinion 6, teeth 15 of wheel 5 would break. But this is not the case as a result of the presence of sliding wheel and pinion 4 which is immediately ejected from chain 3, wheel 5 being then able to rotate freely during the shock.

In an electronic watch, a gear ratio of approximately 100 is generally provided between the oscillating weight and the generator rotor, to allow said generator to provide sufficient electromotive force across the terminals of its stator winding. This better explains why during shocks, the generator rotor can be considered as blocked and if no action were taken, the teeth of one of the wheel and pinions of the kinematic chain would break. In a self-winding watch however, this gear ratio is considerably lower. However, as stated hereinbefore, there is a risk of the mainspring of the barrel being blocked if a defect occurs as regards the slipping spring. At this moment, the use of the device according to the invention is entirely justified.

Figure 3:
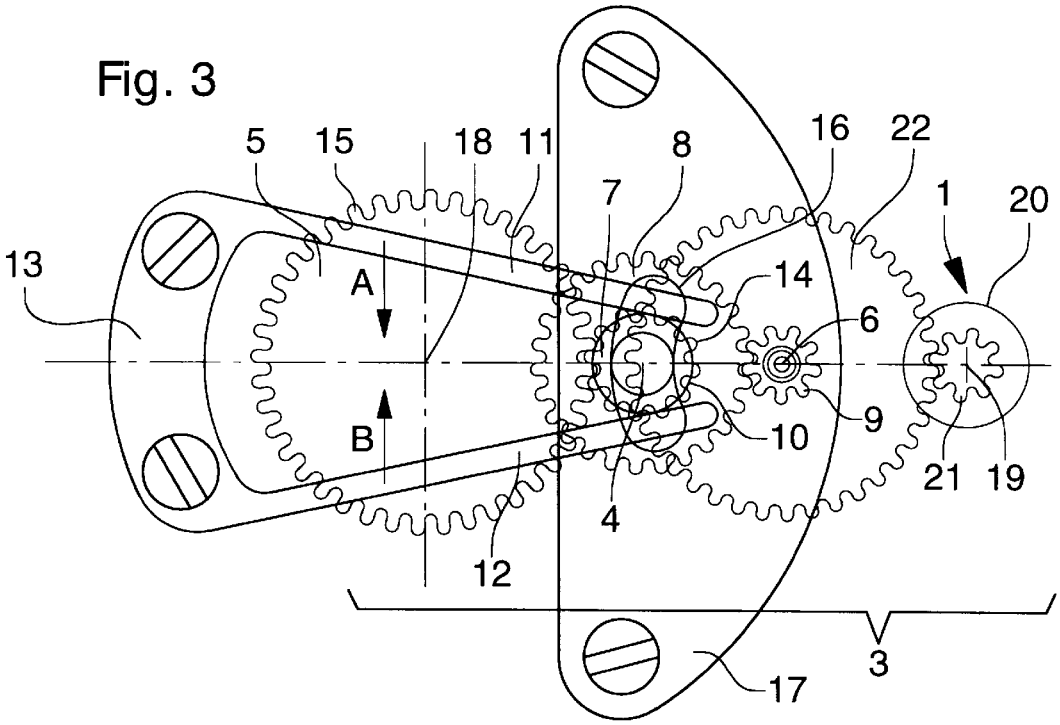
FIG. 3 is an enlarged scale plane view of the gear train executed according to the invention when the instrument is operating normally.
Figure 4:
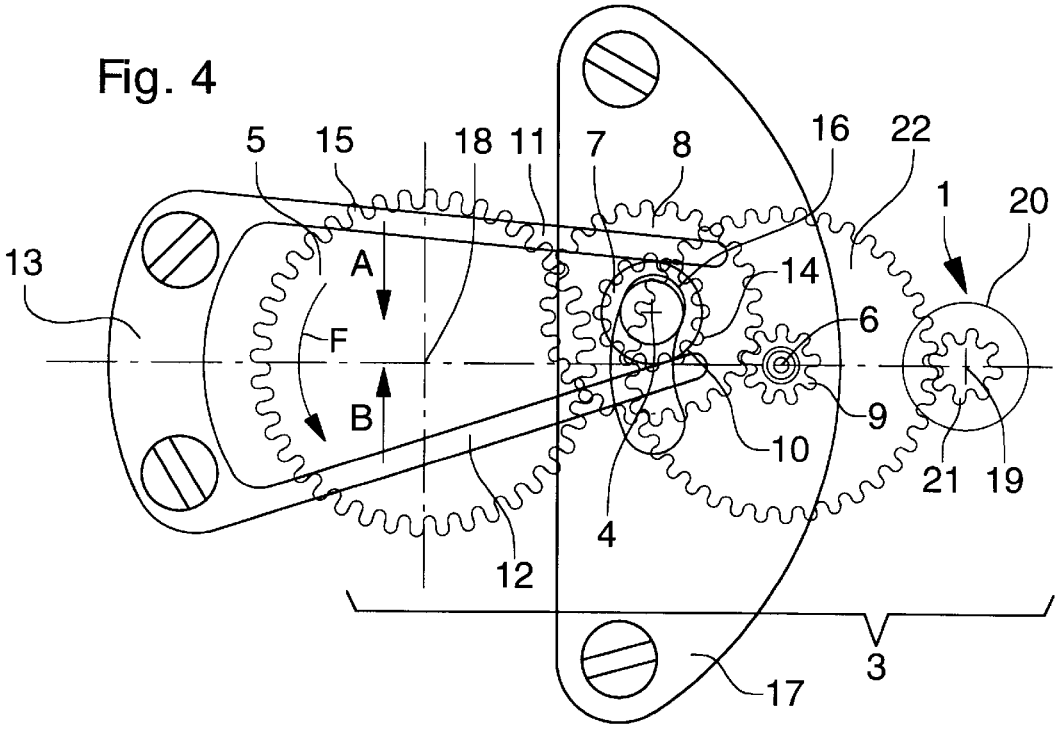
FIG. 4 is an enlarged scale plane view of the gear train executed according to the invention when the instrument undergoes a shock.

The situation of sliding wheel and pinion 4 shown in FIG. 4 corresponds to a shock in the direction of arrow F. Strips 11 and 12 of spring 13 are respectively taut and relaxed and are thus moved away from the equilibrium position shown in FIG. 3. When the shock disappears, strip 11 pushes the sliding wheel and pinion back into chain 3 along arrow A. It will be understood that if the shock occurred in the other direction, it would be strip 12 which was taut and strip 11 relaxed. It will also be noted that the elastic constant of arms 11 and 12 of spring 13 will be selected so that the ejection of sliding wheel and pinion 4 occurs as soon as the acceleration of oscillating weight 2 exceeds that occurring in normal use, thus exceeds a certain limit. A weight acceleration of 500 g as limit value is willingly cited.

Different trajectories can be envisaged for sliding wheel and pinion 4 to allow it to withdraw from chain 3 at the moment of shock. As is seen in FIGS. 1, 3 and 4, sliding wheel and pinion 4 can escape from chain 3 if it is mounted as a satellite around intermediate wheel and pinion 6. In order to do this, shaft 10 of sliding wheel and pinion 4 is guided into a banana-shaped oblong opening 16 made in a fixed bridge 17. Thus, the wheel of sliding wheel and pinion 4 remains meshed with pinion 9 of intermediate wheel 6 when teeth 14 of pinion 7 of said sliding wheel and pinion 4 escape from teeth 15 of wheel 5 of oscillating weight 2 during a shock.

Instead of guiding shaft 10 of sliding wheel and pinion 4 into a banana-shaped opening, sliding wheel and pinion 4 could be rotatively mounted onto a stud, such stud being arranged on a pivotably mounted bridge on the shaft about which intermediate wheel and pinion 6 rotates. A satellite trajectory would thus be obtained for sliding wheel and pinion 4 about the intermediate wheel and pinion, although this embodiment is not shown in the drawing.

The above description concerns above all the actuation of an electricity generator driven by an oscillating weight. In the event that this weight actuates a mainspring of the barrel, it is obvious that the sliding wheel and pinion can be mounted in the kinematic chain arranged between the weight and the mainspring.

What is claimed is:

1. A driving device for a power generator for powering an instrument of small volume, said device including a gear train driving said generator from an oscillating weight moved by gravity, said train including a plurality of wheels and pinions arranged in a chain, wherein the chain includes a sliding wheel and pinion arranged to disengage from at least one of the other wheel and pinions and thus to interrupt said chain when the oscillating weight is subjected to an acceleration substantially exceeding that occurring during normal use of said instrument.

2. A device according to claim 1, wherein the power generator is a spring mounted in a barrel.

3. A device according to claim 1, wherein the power generator is a generator generating an electric voltage.

4. A device according to claim 1, wherein the sliding wheel and pinion is driven by a wheel attached to the oscillating weight, said sliding wheel and pinion in turn driving an intermediate wheel and pinion meshed with the power generator.

5. A device according to claim 4, wherein the sliding wheel and pinion includes a pinion meshed with the wheel attached to the oscillating weight and a wheel meshed with a pinion forming part of the intermediate wheel and pinion, and wherein opposing forces of two strips of a positioning spring are exerted on the shaft of the sliding wheel and pinion to keep said sliding wheel and pinion in the chain when the oscillating weight is subjected to a normal acceleration; and wherein the trajectory of said sliding wheel and pinion is determined so that the teeth of its pinion are driven out of the trajectory of the teeth of the wheel attached to the oscillating weight when said weight is subjected to an acceleration substantially exceeding that occurring during normal use of the instrument.

6. A device according to claim 5, wherein the sliding wheel and pinion rotates as a satellite about the intermediate wheel and pinion, and wherein the shaft of said sliding wheel and pinion is guided in a banana-shaped oblong opening made in a fixed bridge.

7. A device according to claim 5, wherein the sliding wheel and pinion rotates as a satellite about intermediate wheel and pinion, and wherein said sliding wheel and pinion is rotatively mounted onto a stud arranged on a bridge pivotably mounted on the shaft about which the intermediate wheel and pinion rotates.

* * * * *